US008136193B2

(12) United States Patent
Larkowski et al.

(10) Patent No.: US 8,136,193 B2
(45) Date of Patent: Mar. 20, 2012

(54) SIDE BROOM HAVING MEMORY RECALL AND METHOD FOR PERFORMING THE SAME

(75) Inventors: Stephen James Larkowski, Elgin, IL (US); Brian Patrick Salapatek, Cortland, IL (US)

(73) Assignee: Federal Signal Corporation, Oak Brook, IL (US)

( * ) Notice: Subject to any disclaimer, the term of this patent is extended or adjusted under 35 U.S.C. 154(b) by 692 days.

(21) Appl. No.: 12/173,507

(22) Filed: Jul. 15, 2008

(65) Prior Publication Data

US 2010/0011523 A1 Jan. 21, 2010

(51) Int. Cl.
*E01H 1/04* (2006.01)

(52) U.S. Cl. ..... 15/87; 15/82; 15/340.3

(58) Field of Classification Search ..... 15/78, 82, 15/83, 87, 340.3

See application file for complete search history.

(56) References Cited

U.S. PATENT DOCUMENTS

| | | | | |
|---|---|---|---|---|
| 3,293,679 | A | 12/1966 | Murphy | |
| 4,222,141 | A | 9/1980 | Kieft | |
| 4,490,874 | A * | 1/1985 | Duncan | 15/87 |
| 4,872,233 | A | 10/1989 | Brown | |
| 5,060,334 | A | 10/1991 | Strauser | |
| 5,251,652 | A | 10/1993 | Strauser | |
| 5,852,847 | A | 12/1998 | Weiss | |
| 6,605,156 | B1 * | 8/2003 | Clark et al. | 134/6 |
| 6,618,897 | B2 * | 9/2003 | Lewis et al. | 15/340.3 |
| 6,675,424 | B2 * | 1/2004 | Smith et al. | 15/87 |
| 6,854,157 | B2 | 2/2005 | Strauser | |
| 6,877,180 | B2 * | 4/2005 | Wilmo et al. | 15/83 |
| 2006/0053583 | A1 | 3/2006 | Giles et al. | |

* cited by examiner

*Primary Examiner* — Mark Spisich
*Assistant Examiner* — Michael Jennings
(74) *Attorney, Agent, or Firm* — Merchant & Gould, P.C.

(57) ABSTRACT

The present disclosure relates generally to debris collection devices. In particular, the present disclosure relates to a debris collection vehicle utilizing a side broom having memory recall functionality.

14 Claims, 20 Drawing Sheets

SIDE BROOM HAVING MEMORY RECALL AND METHOD FOR PERFORMING THE SAME

TECHNICAL FIELD

The present disclosure relates generally to debris collection devices. In particular, the present disclosure relates to a debris collection vehicle utilizing a side broom having memory recall functionality.

BACKGROUND

Debris-collection vehicles, especially street sweepers, typically utilize a mechanical debris collection system to move debris and the like from a cleaning surface into an on-board debris containment unit. The debris collection system can include one or more rotating side brooms having a spatial displacement mechanism and a side broom tilt mechanism functioning in tandem to deploy the side broom to the cleaning surface, whereby the side broom transfers debris into the debris containment unit via a debris transport mechanism, such as an inlet and vacuum assembly.

One concern with side broom technology relates to the efficient and repeatable deployment of the side broom. In general, side broom deployment is a repetitive motion requiring precise knowledge of a side broom positioning and a side broom tilt angle to optimize sweeping efficiency for any given cleaning surface. This can be a difficult task for an operator who is frequently required to manually deploy, retract and position the side broom and side broom tilt angle from an operator station located in a cab on the debris collection vehicle. For this and other reasons improvements are desirable.

SUMMARY

In accordance with the following disclosure, the above and other problems are solved by the following:

In a first aspect, a debris collection vehicle is disclosed. The debris collection vehicle having a chassis and a cab wherein a broom linkage assembly is connected to the chassis. The broom linkage assembly enabling a broom tilt, position, and rotation. The debris collection vehicle including a broom connected to the broom linkage assembly for cleaning a cleaning surface and a broom controller configured to control the broom linkage. The broom controller includes a memory for storing a current broom tilt, position, and rotation and recalling stored broom tilt, position, and rotation such that the broom controller can store a current broom tilt, position, and rotation and later recall that broom tilt, position, and rotation to redeploy the broom to a previously stored position.

In a second aspect, a tilt controller positioned on a debris collection device is disclosed. The tilt controller having a hardware and a software component configured to control a side broom tilt, a side broom positioning, and a side broom rotation, wherein the tilt controller can recall the side broom positioning and the side broom tilt for automatic displacement of the side broom. The tilt controller includes a memory element to store a side broom tilt angle and a side broom positioning, and a memory recall module to automatically position the side broom tilt and side broom positioning, the memory recall module obtaining the side broom tilt angle and the side broom positioning from the memory element.

In a third aspect, a method of automatically deploying a side broom positioned on a debris collection vehicle having a chassis and a cab, wherein a tilt controller is configured to actuate the side broom to a known side broom positioning and a known side broom tilt is disclosed. The method comprises recalling a previously stored side broom tilt angle and a side broom 3-dimensional coordinate from a memory element, deploying the side broom to the 3-dimensional coordinate via a broom linkage connected to the chassis, and actuating the side broom to the side broom tilt angle via a tilt actuator positioned on the side broom.

BRIEF DESCRIPTION OF THE DRAWINGS

Aspects of the present disclosure may be more completely understood in consideration of the following detailed description of various embodiments in connection with the accompanying drawings, in which.

DETAILED DESCRIPTION

Figure 1:
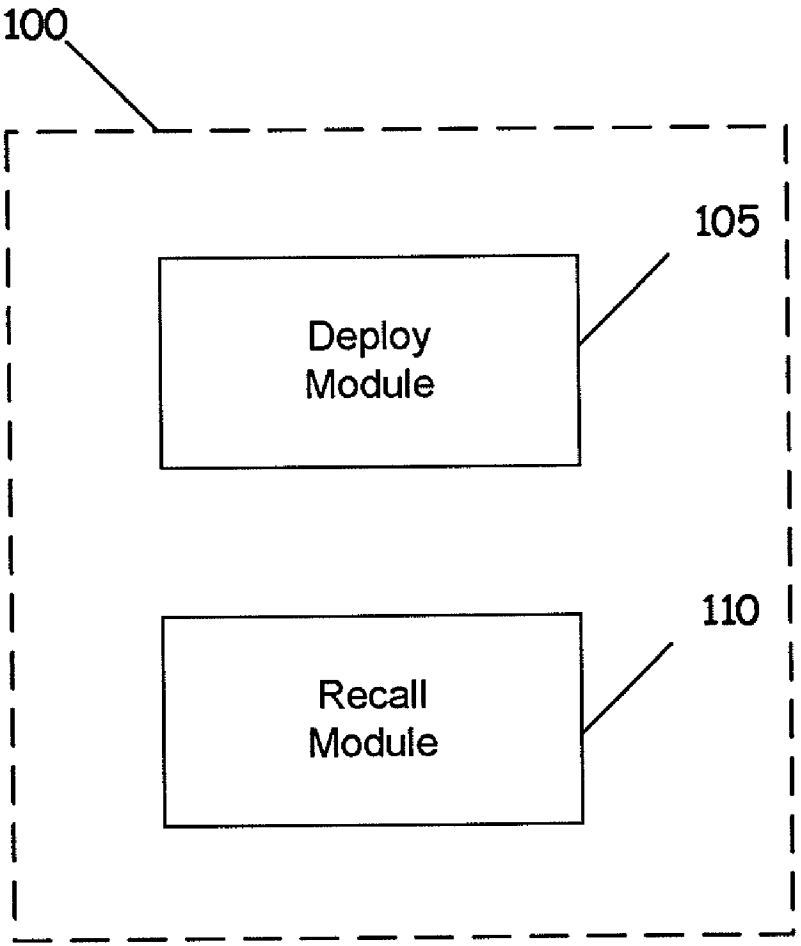
FIG. 1 is an example embodiment for a side broom memory recall system.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The present disclosure generally relates to a side broom for a debris collection vehicle, such as a street sweeper. In general, the side broom is positioned on a debris collection vehicle chassis and incorporates a memory recall positioning functionality to automatically position the side broom and a side broom tilt angle with a high degree of accuracy and repeatability.

In a preferred example embodiment an operator stationed in a cab of the debris collection vehicle can automatically position the side broom and the side broom tilt angle via a tilt controller. The tilt controller being interfaceable from a central console positioned in the cab. In general, the tilt controller is configured to recall the side broom tilt angle and the spatial positioning of the side broom from a memory element. The memory element is utilized to store the side broom tilt angle and the side broom positioning as parameters. Additionally, the tilt controller is configured to actuate a linkage assembly to mechanically position the side broom accordingly.

In practice, the operator can engage a specific side broom mode such that a memory recall module is engaged to retrieve the parameters from the memory element. Next, a deployment sequence is implemented to automatically deploy the side broom to the designated spatial position and tilt angle based on the retrieved parameters. The operator is notified in real time the status of the side broom via a feedback mechanism that displays the side broom position and side broom tilt angle to the operator via displays on the central console.

Upon completion of the automatic side broom deployment sequence, the operator has the ability to manually manipulate the positioning of the side broom and the side broom tilt angle as desired to optimize the side broom cleaning effectiveness. Subsequently, the operator is provided an option to store a new set of side broom parameters in the memory element. It will be appreciated that the memory element is extensible in that a plurality of stored side broom parameter values may be saved and made available for recall.

While an example preferred embodiment and application has been listed, it will be appreciated that a memory recall positioning functionality in accordance with the principles of the present disclosure can be used for any application where accurate and automated positioning and control are desirable, as illustrated and described in greater detail below.

Referring to FIG. 1, an example embodiment for a side broom memory recall system 100 is shown. In its most basic configuration, the present disclosure may be described in terms of one or more functional modules that may be combined or enabled as desired in various embodiments. For example, it will be appreciated that the memory recall positioning system 100 may be implemented via a functional module representing operator actions, a functional module representing software and/or hardware, or any combination thereof.

Accordingly, representative of the basic principles of the present disclosure, the side broom memory recall positioning system 100 can include a deploy module 105 and a recall module 110. In general, the deploy module 105 can be engaged to manually manipulate a side broom and a side broom tilt angle to a desired position. For example, in one embodiment, the deploy module 105 can be engaged to actuate the side broom from a stowed position to a deployed position, such that the side broom can be utilized to clean a surface. The recall module 110 can be engaged to automatically retract or return the side broom and side broom tilt angle to a predetermined desired position. In this manner, as described in further detail throughout the present disclosure, the recall module 110 can embody systems and methods to retrieve programmable side broom positioning information from a memory element and subsequently actuate the side broom to a desired position. Further details regarding environments in which the side broom memory recall positioning system 100 are implemented and enabled are described below in conjunction with FIGS. 2-19.

Figure 2:
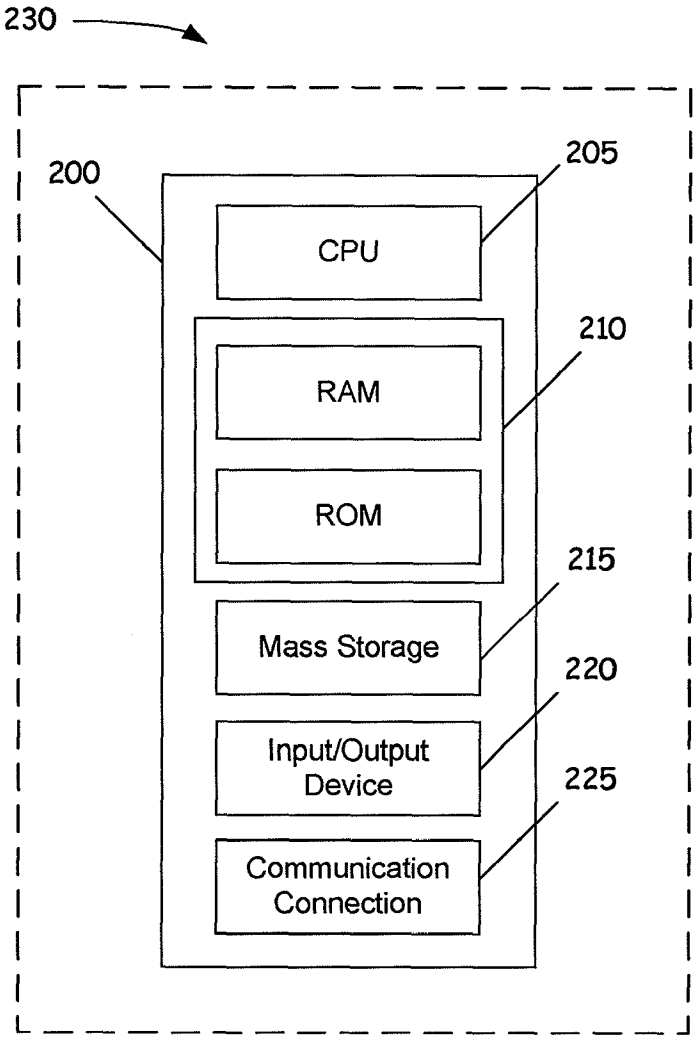
FIG. 2 is an example of a general purpose computing system environment.

Referring to FIG. 2, an example environment for implementing various embodiments of the disclosure includes a general purpose computing system environment 230. In the example embodiment the computing system environment 230 includes a computing device 200. In examples described herein, the computing devices includes a processing unit (CPU) 205 and one or more computer readable media 210 such as volatile memory (RAM), non-volatile memory (ROM, flash memory, etc.) or any combination thereof. Additionally, the computing system 200 can also include mass storage 215 (removable and/or non-removable) such as a magnetic or optical disks, one or more application programs can be stored on the mass storage device. The computing device 200 can include input/output devices 220 such as a keyboard and a monitor or display. The computing device 200 can also include one or more communication connections 225 for the relaying of information to and from other devices such as sensors, actuators, displays, other computers, etc. The relaying of information via the communication connections 225 can be implemented using wired and/or wireless technologies. The computing system environment is only one example of a representative computing 200 and is not intended to suggest any limitation as to the scope of use or functionality of the invention.

Figure 3:
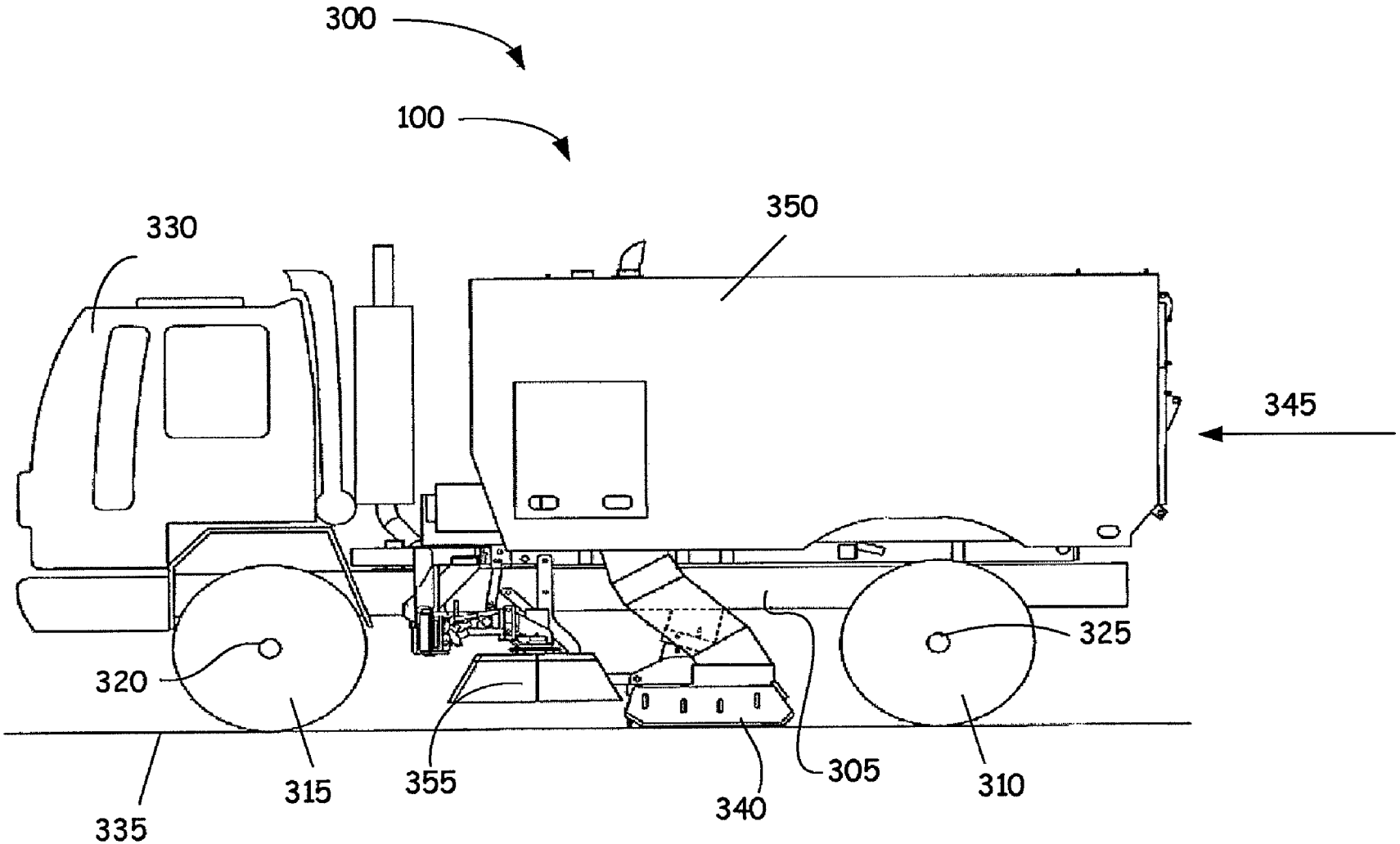
FIG. 3 is a side view of an example debris collection vehicle including a side broom with a memory tilt functionality.

Referring to FIG. 3, a perspective view of a debris collection vehicle 300 is shown according to a possible embodiment of the present disclosure. Preferably, the debris collection vehicle 300 is of the four wheeled arrangement and includes a chassis 305 mounted on a pair of front wheels 315 and a pair of rear wheels 310 that are connected to front and rear axles 320, 325 respectively. Other configurations are possible. The debris collection vehicle 300 also includes a cab 330 attached to the chassis 305 located above a street surface 335. The cab 330 is an enclosed structure that protects an operator from environmental elements during debris collection vehicle 300 operation. In general, located within the cab 330 are operator controls for steering and controlling debris collection functions.

There are many different methods the debris collection vehicle 300 can employ to remove debris from a cleaning surface 335. For example, the debris collection vehicle 300 includes a high speed pick-up head 340 that is disposed between the front axle 320 and the rear axle 325. The pick-up head 340 is generally box-like or rectangular in configuration, with an associated width and a length. When the pick-up head 340 is assembled to the debris collection vehicle 300, the length is generally parallel to the front and rear axles 320, 325 and extends in a generally transverse direction with respect to a direction of travel 345. The width, in contrast, is generally perpendicular to the front and rear axles 320, 325 and extends in a parallel direction with respect to the direction of travel 345. In this way, the length of the pick-up head 340 defines a path of debris removal along the cleaning surface 335 to be cleaned when the debris collection vehicle 300 moves along the direction of travel 345. The pick-up head 340 is configured to be connected to a debris hopper 350, as described below Additionally, the debris collection vehicle 300 can include a main broom (not shown) and a vacuum nozzle (not shown) to remove debris from the cleaning surface 335. The vacuum nozzle is configured to be connected to the debris hopper 350 via a plurality of hoses (not shown). The main broom is rotatable with respect to the chassis 305 along an axis of rotation that runs parallel to the cleaning surface 335. The main broom can include a plurality of bristles and the rotation can be hydraulically powered by a hydraulic unit. It will be appreciated that the plurality of bristles can be formed from any resilient material, such as a metallic wire or a polymer composite. The main broom can be raised from a deployed sweeping position wherein the broom contacts the cleaning surface 335 to avoid excessive wear when a surface mechanism is not required.

For receiving and holding debris removed from the cleaning surface 135 by the pick-up head 340 and/or the main broom, the debris collection vehicle 300 includes a debris hopper 350 supported by the chassis 305. There are many different methods to remove debris from the debris hopper 350. For example, the debris hopper 350 can be lifted and tilted with respect to the chassis 305 via hydraulic power to empty debris. In another possible embodiment a mechanical conveyor assembly (not shown) can be mounted to the chassis 305 to transfer debris from the pick-up head 340 or the main broom to the hopper 350. Additionally, the hopper 350 can be separable from the chassis 305 to function as a stand-alone trash receptacle.

It will be appreciated that the respective mechanisms for moving, receiving and holding debris embodied by the debris collection vehicle can have any number of conventional configurations. For example, the debris collection vehicle 100 may include a water tank (not shown) with complementary apparatus to aid with dislodgment of debris from the cleaning surface 335.

Figure 4:
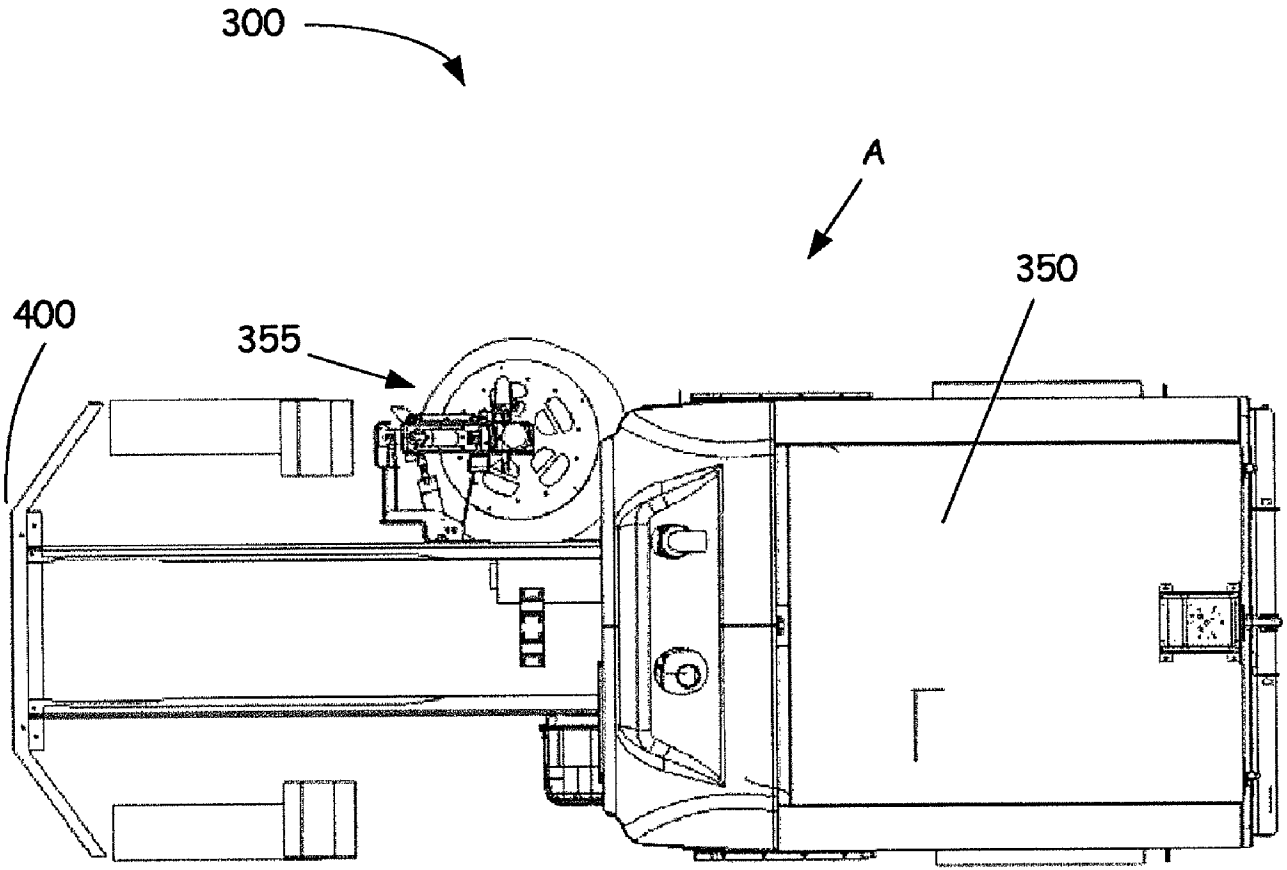
FIG. 4 is a top view of the example debris collection vehicle of FIG. 3 having a side broom in a stowed position.

Referring now to FIG. 4, a top view of the debris collection vehicle 300 is shown including a side broom 355 generally positioned on a first side A between a front end 400 and the hopper 350. In general, there are many other possible configurations for the side broom 355 positioned on the debris collection vehicle 300. For example, the debris collection vehicle 300 may include a pair of side brooms 355 that are disposed on opposite sides of the debris collection vehicle 300 with respect to each other. Further, the debris collection vehicle may include any number of pairs of side brooms 355 in that each respective pair is disposed on opposite sides of the debris collection vehicle 300 with respect to each other. Herein the terms "side broom" and "side brooms" are to be construed to cover both the singular and the plural, unless otherwise noted.

In general, the side broom 355 is operatively configured to be physically deployed via a spatial displacement mechanism from a stowed position, in that the side broom 355 is in a stored configuration fully retracted from the cleaning surface 335, to a deployed position such that the side broom 355 is extended and in contact with the cleaning surface 335. Additionally, there are many other possible features and embodiments that a side broom 355 positioned on a debris collection device 300 can employ to facilitate cleaning surface 335 sweeping. For example, the side broom 355 may include a water jet cleaning mechanism (not shown) with complementary apparatus to aid with dislodgment of debris from the cleaning surface 335. Additionally, a side broom tilt mechanism can be provided to allow the side broom 355 additional flexibility in reaching features of a cleaning surface generally inaccessible by a side broom without a tilt mechanism. The features and flexibility of a side broom 355 having a side broom tilt mechanism are described in further detail below.

Figure 5:
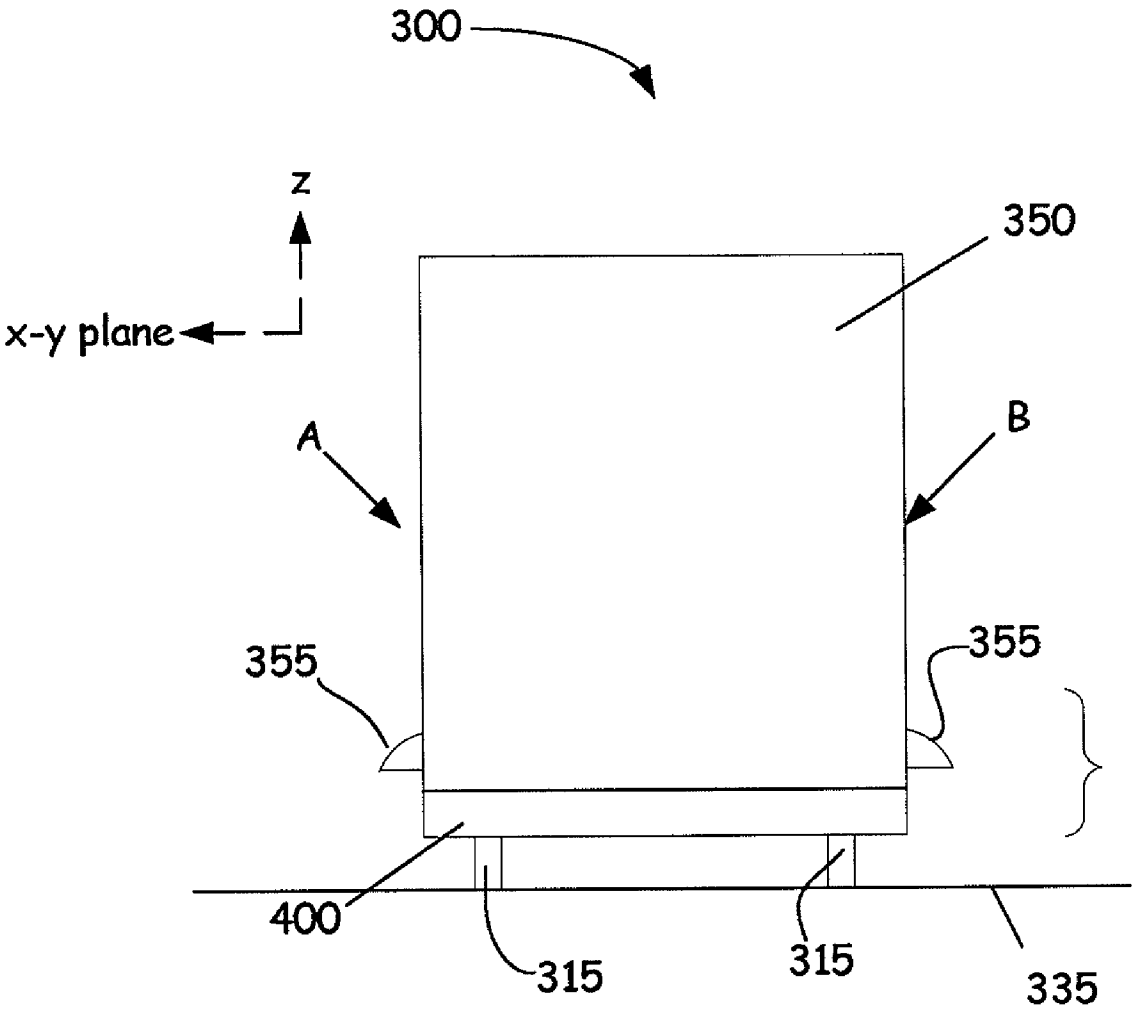
FIG. 5 is a front view of the example debris collection vehicle of FIG. 3 having a pair of side brooms stored in a stowed position.

Referring to FIG. 5, a frontal view of a debris collection vehicle 300 is shown in that a pair of side brooms 355 disposed on opposite sides (sides A and B, respectively) of the debris collection vehicle 100 are in a stowed position 500 such that the side brooms 355 are situated inwardly towards the chassis 305 and raised from the cleaning surface 335. The stowed position 500 is a preferable position for the side brooms 155 when the debris collection vehicle 300 is in transit between cleaning sites.

Figure 7:
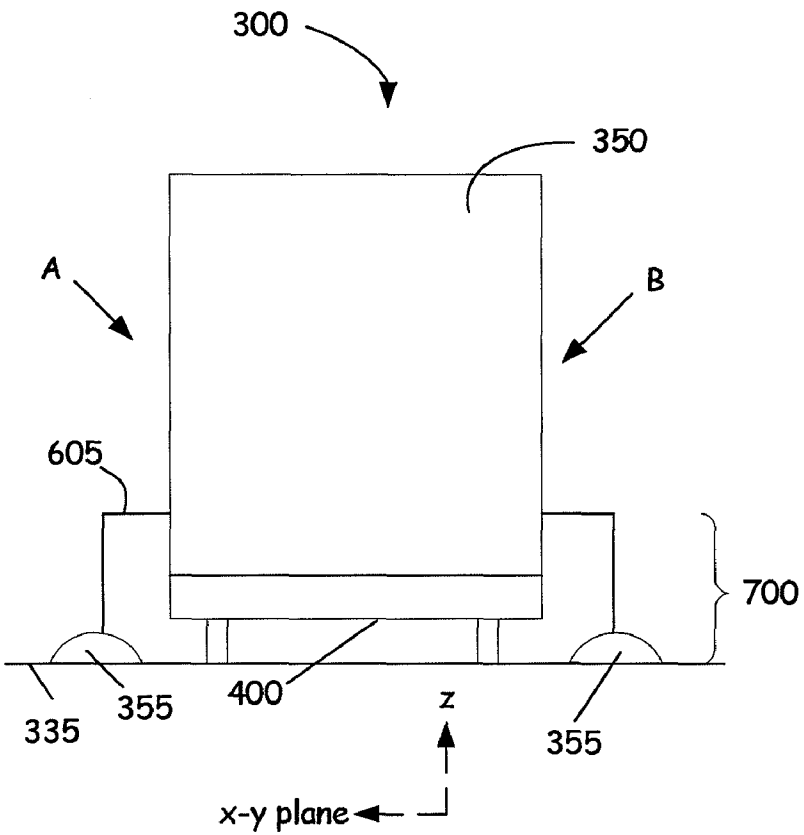
FIG. 7 is a front view of the example debris collection vehicle of FIG. 3 having a pair of side brooms in an extended/lowered position.
Figure 6:
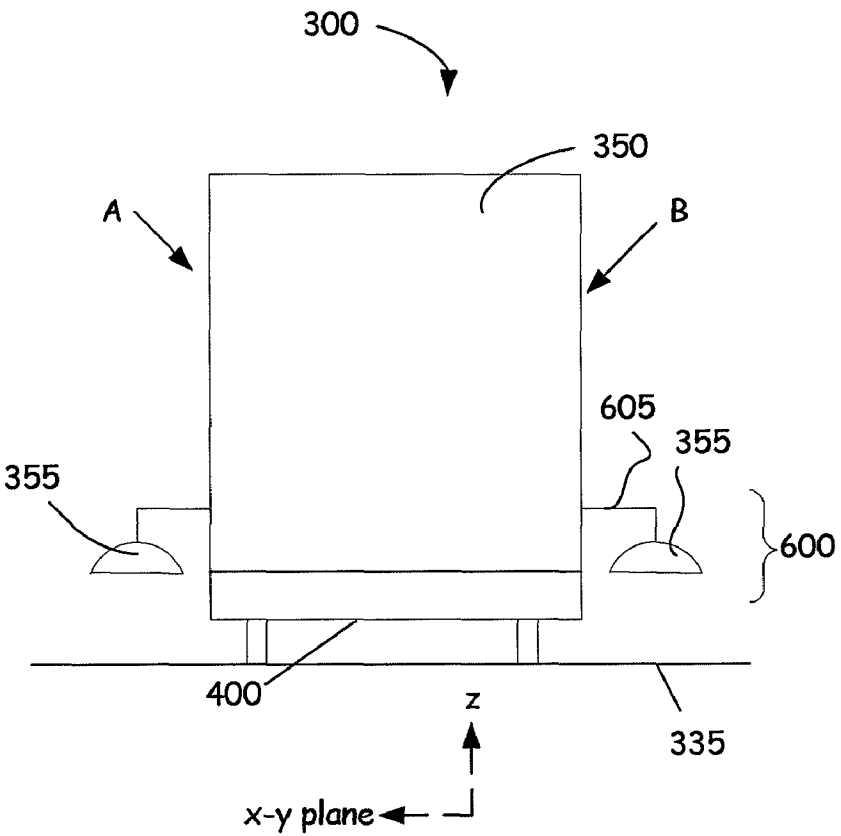
FIG. 6 is a front view of the example debris collection vehicle of FIG. 3 having a pair of side brooms in an extended/raised position.
Figure 9:
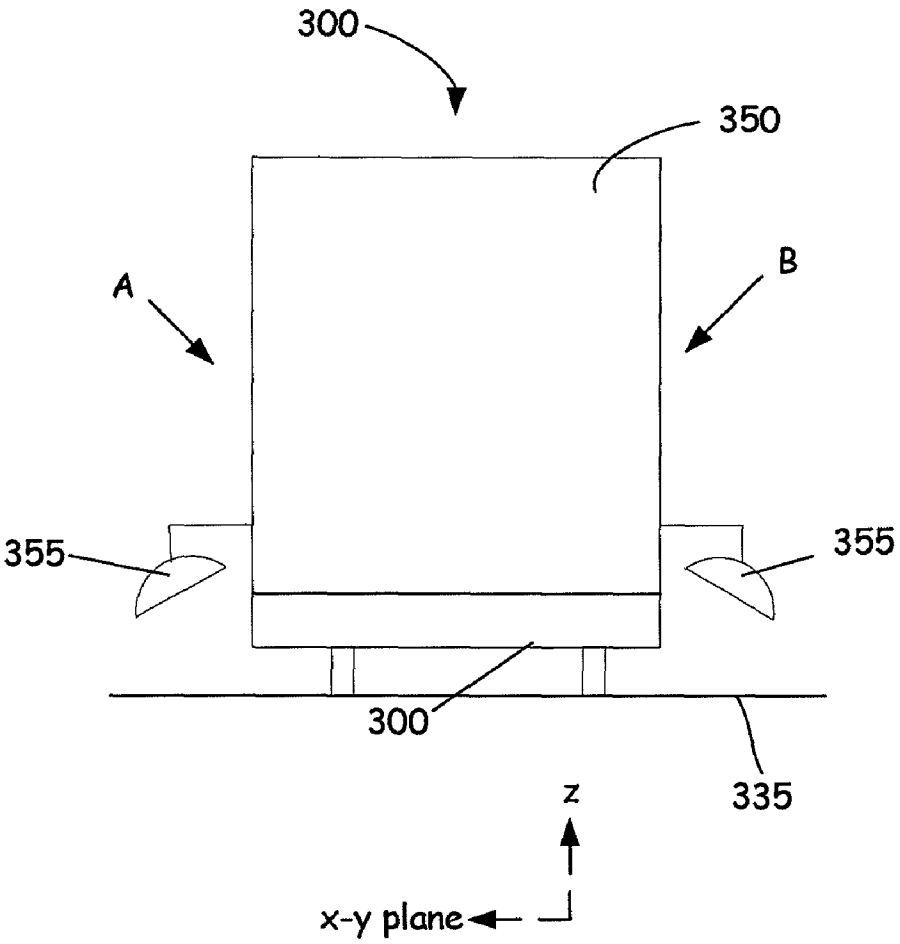
FIG. 9 is a front view of the example debris collection vehicle of FIG. 5 having a pair of side brooms tilted outwardly towards the debris collection vehicle.
Figure 8:
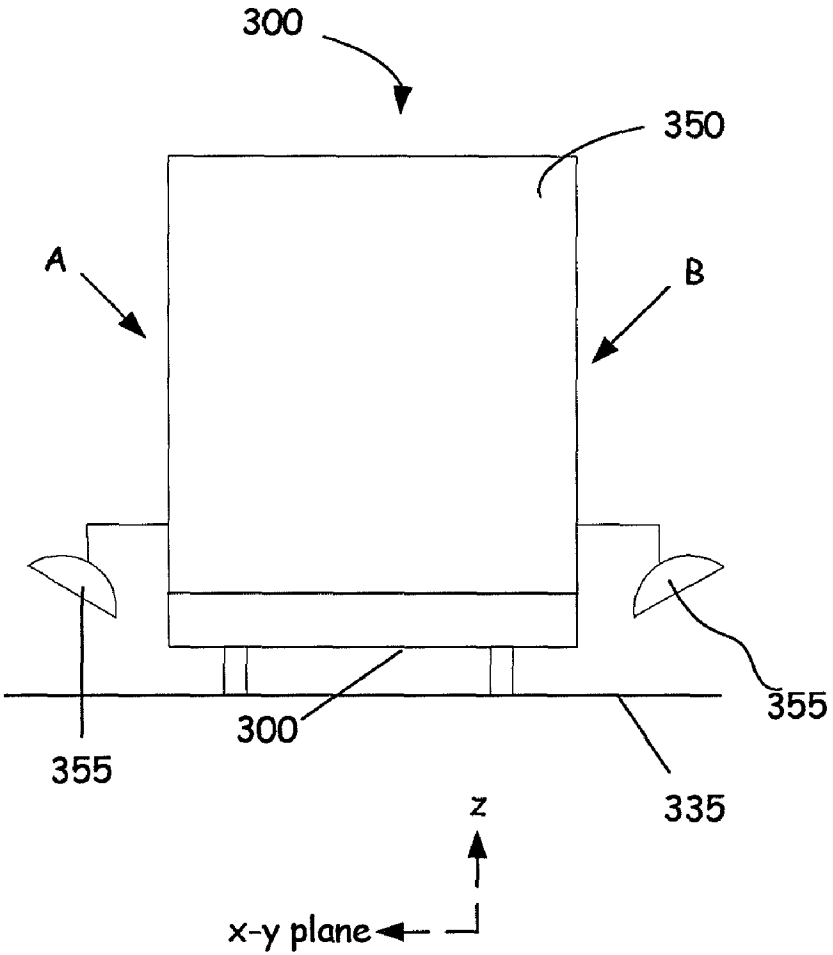
FIG. 8 is a front view of the example debris collection vehicle of FIG. 5 having a pair of side brooms tilted inwardly from the debris collection vehicle.

Referring to FIG. 6, a planar side broom displacement from the stowed position 500 to an extended/raised position 600 is mechanically accomplished utilizing a broom linkage assembly 605. In the extended/raised position 605, the side brooms 355 generally extend perpendicularly outward from the debris collection vehicle 300 and are raised from the cleaning surface 335. Side broom deployment to a cleaning surface 335 is completed with a vertical displacement as shown in FIG. 7. The vertical side broom displacement is similar with respect to the planar side broom displacement in that it is accomplished with the broom linkage assembly 605, wherein the side brooms 355 are mechanically moved between the extended/raised position 600 to an extended/lowered position 700 such that the side brooms 355 are in association with the cleaning surface 335.

Figure 10:
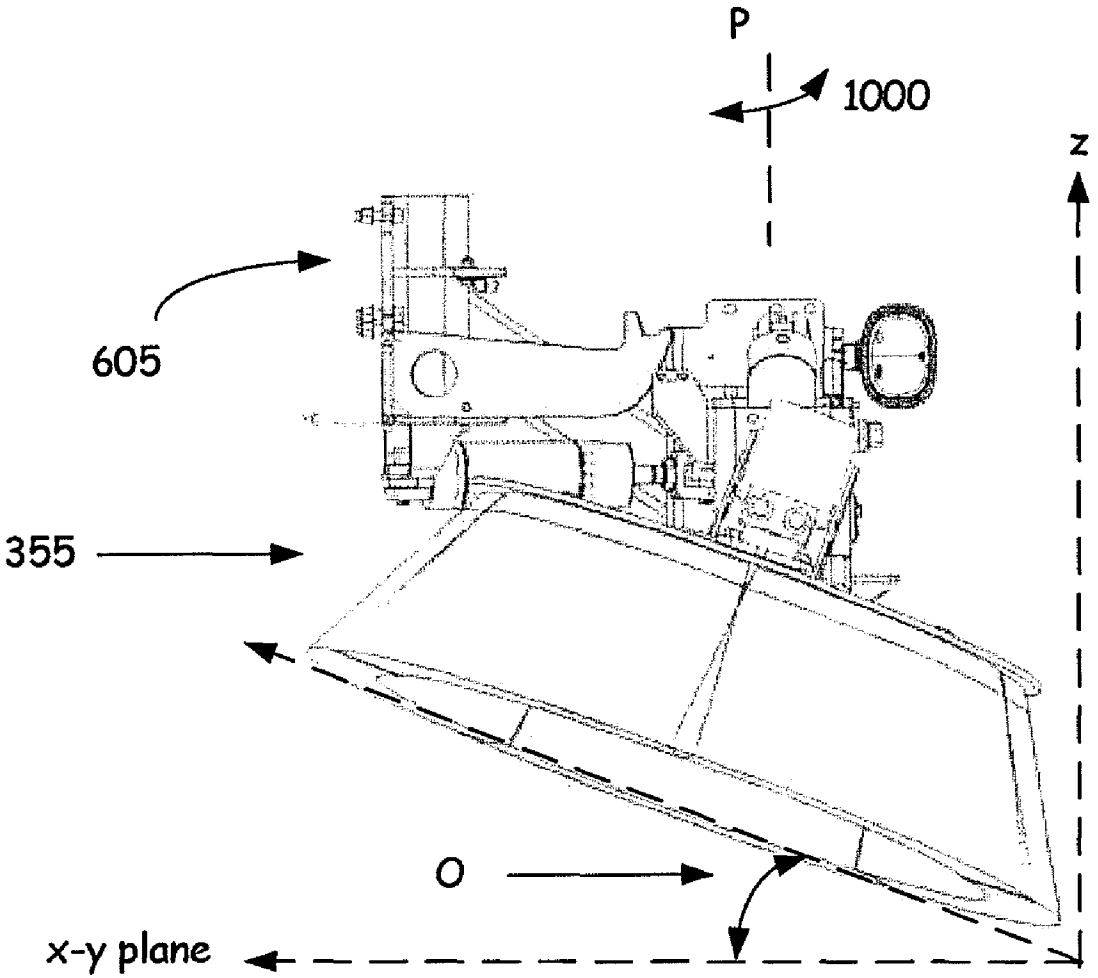
FIG. 10 is a perspective view of a side broom illustrating a side broom tilt angle.

In the example embodiment, an additional side broom capability is embodied as a side broom tilt mechanism, where in general, the side brooms 355 are capable of being independently tilted with respect to the debris collection vehicle 300. For example, in FIG. 8 the side brooms 355 are in the extended/raised position 600 and are tilted inwardly from the debris collection vehicle 300. Similarly, in FIG. 9 the side brooms 355 are in the extended/raised position 600 but are tilted outwardly towards the debris collection vehicle 300. In an example embodiment, a side broom tilt angle O is enabled with full range of motion ranging from 0 degrees to 90 degrees with respect to a normal axis P, as shown in FIG. 10. In a preferred example embodiment, the side broom tilt angle O is enabled with a range of motion ranging from 0 degrees to 20 degrees. It will be appreciated that the side brooms 355 can be tilted in any orientation with respect to the normal axis P. In addition to the side broom tilt mechanism the side brooms 355 are independently and variably rotatable in a counter-clockwise or a clockwise direction 1000 about the axis P to provide a sweeping motion.

Figure 11:
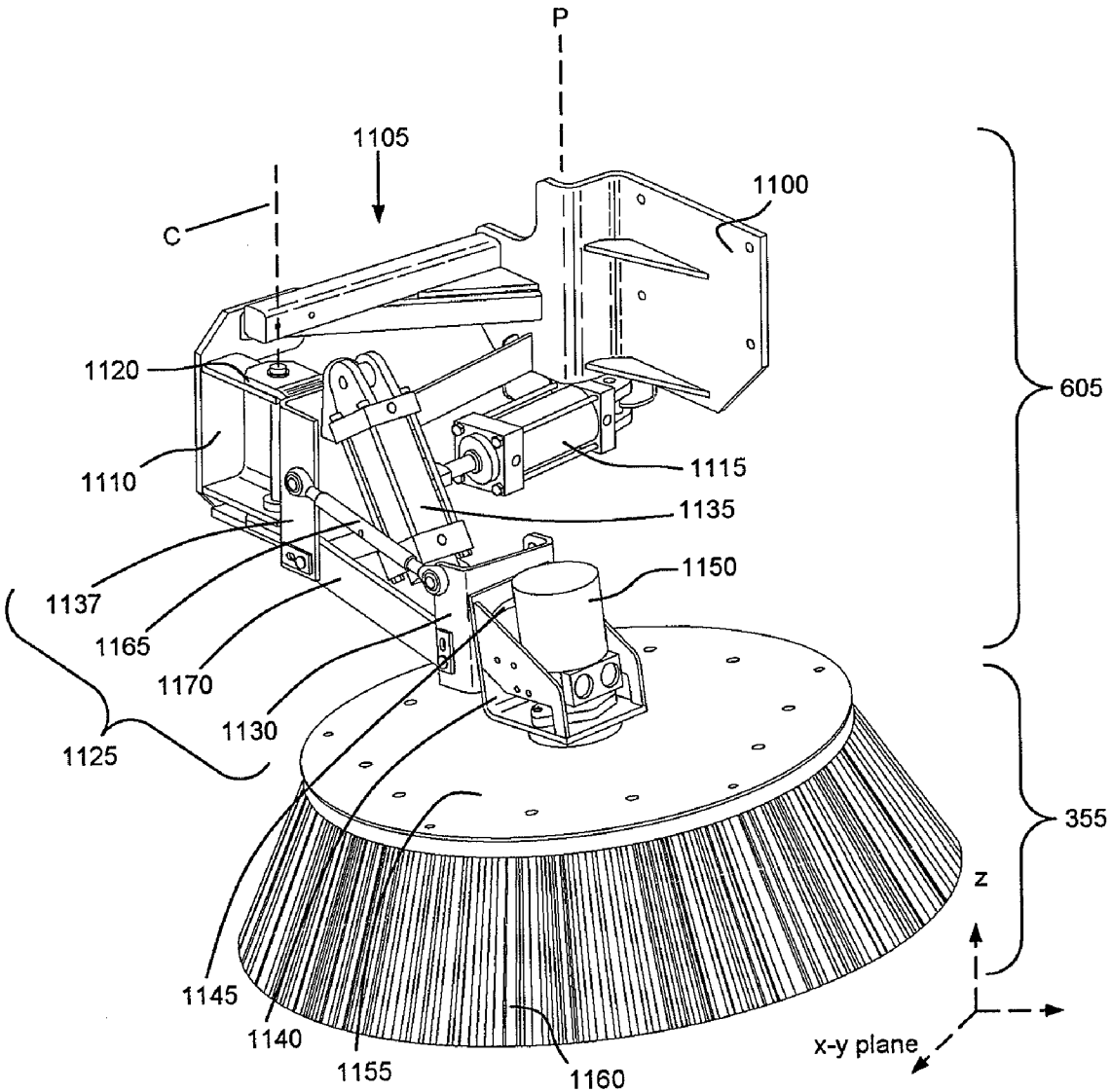
FIG. 11 is a perspective view of a side broom and a broom linkage assembly.

Referring now to FIG. 11, in one possible embodiment the side broom 355 is pivotally attached to a broom linkage assembly 605, which in turn is rigidly mounted to the debris collection vehicle chassis 305 (FIG. 3) with a first mounting plate 1100. Preferably, the broom linkage assembly 605 includes a first linkage arm 1105 extending perpendicularly outward from the debris collection vehicle chassis 305. The first linkage arm 1105 can be integrally formed with the first mounting plate 1100, a first structural support 1110, a first actuator 1115 and a first hinge 1120 having a pivot axis C.

The first actuator 1115 enables the broom linkage assembly 605 to move the side broom 355 in an planar x-y direction with a range of motion ranging from an inwardly position generally near the debris collection vehicle chassis 305 to an outward position generally away from the debris collection vehicle chassis 305.

In particular, the first actuator 1115 can drive the side broom 355 between the stowed position 500 wherein the broom linkage assembly 605 retracts the side broom 355 into a storage space integrally formed by the debris collection vehicle chassis 305 and the cab 330, and the outward extended/raised position 600 whereby the entire broom linkage assembly 605 is perpendicular to the debris collection vehicle chassis 305. In the example embodiment the first actuator 1115 can be pneumatically driven.

A second linkage arm 1125 includes second actuator 1135 that can be integrally formed with an actuator plate 1137, a first tie bar 1165, a second structural support 1170 and a second mounting plate 1130. The second linkage arm 1125 is mounted to the first hinge 1120 with the pivot axis C functioning as a swivel point.

The side broom 355 is mounted to the second mounting plate 1130 with a side broom mounting plate 1140 having swivel guide 1145 described therein. A tilt actuator (not shown) is integrally formed with the second mounting plate 1130 and the side broom mounting plate 1140. The side broom 355 includes a motor 1150 with a driveshaft (not shown) disposed through the center of a circular broom plate 1155. Attached to the circular broom plate is a plurality of brush wires 1160.

The second actuator enables the broom linkage assembly 605 to displace the side broom 355 between the extended/raised position 600 to the extended/lowered position 700 wherein the side broom 355 is engaged with the cleaning surface 335. The swivel guide 1145 enables the electric actuator to tilt the side broom 355 with respect to the static second linkage arm 1125 between a default angle of 0 degrees to a 20 degrees from the normal axis P, as described above.

Figure 12:
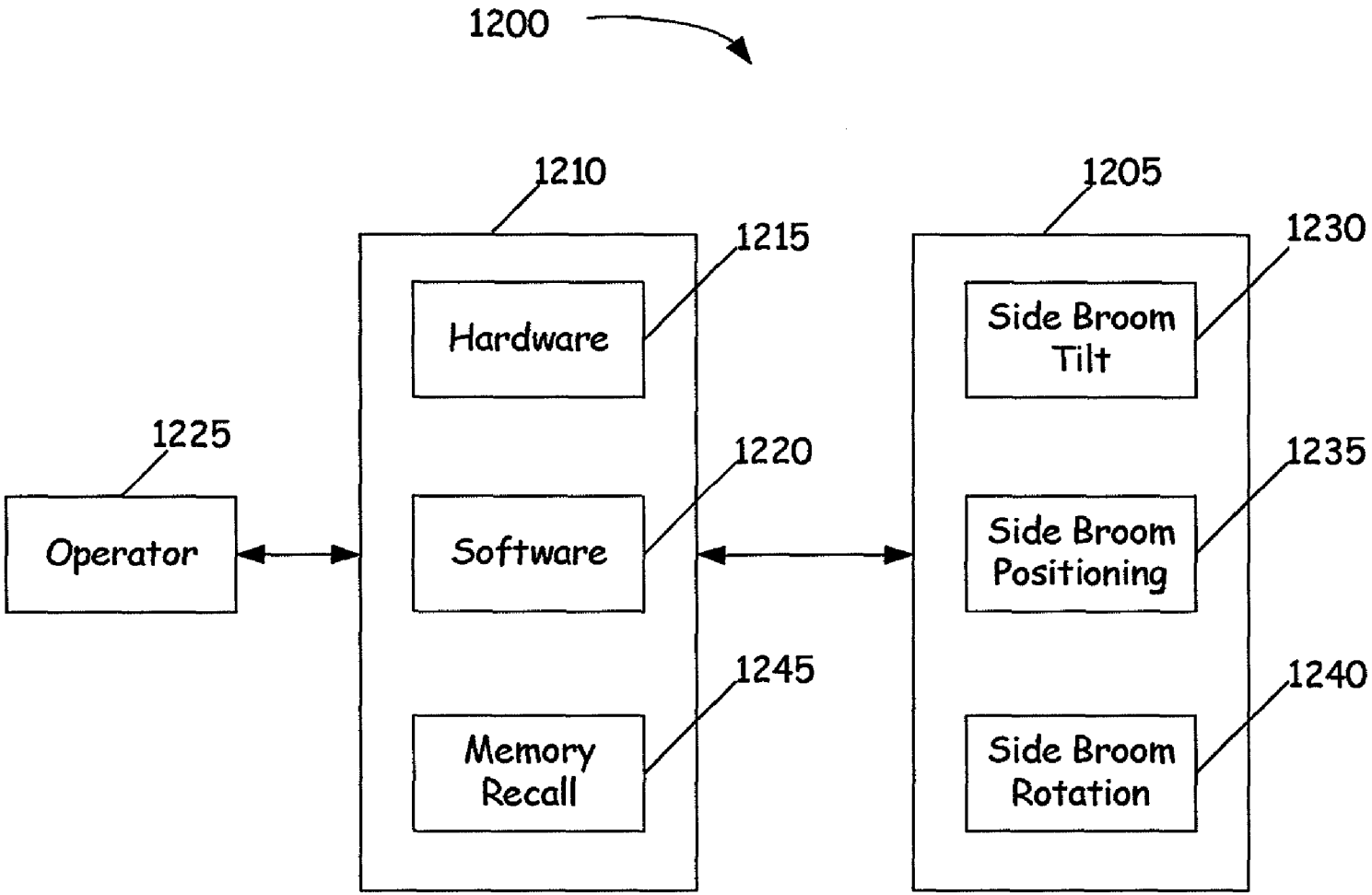
FIG. 12 is an example embodiment regarding implementation for deployment and positioning of a side broom.

Referring to FIG. 12, an example system 1200 regarding implementation for the deployment and positioning of a side broom is shown. In general, the example system 1200 includes a side broom 1205, which is similar to the side broom 355 shown in FIG. 3, and a tilt controller 1210. In general, the tilt controller 1210 consists of a hardware component 1215 and a software component 1220. In general, the side broom 1205 includes a side broom tilt 1230, a side broom positioning 1235, and a side broom rotation 1240. The tilt controller 1210 provides an operator 1225 the ability to independently monitor and manipulate a side broom tilt 1230, a side broom positioning 1235, and a side broom rotation 1240.

The flexibility regarding implementation of the tilt controller 1210 as illustrated in FIG. 12 is evident based on the many possible functional modules that can be executed by a respective hardware component 1215 and software component 1220 architecture. For example, integral with the tilt controller 1310 can be a memory recall module 1245 that can facilitate automatic, repeatable and accurate side broom tilt 1230, side broom positioning 1235, and side broom rotation 1240 with minimal operator 1225 effort. It will be appreciated that the tilt controller 1210 may be implemented by any number of common methods, for example, the tilt controller 1210 may be fully implemented in hardware or fully implemented in software.

Figure 13:
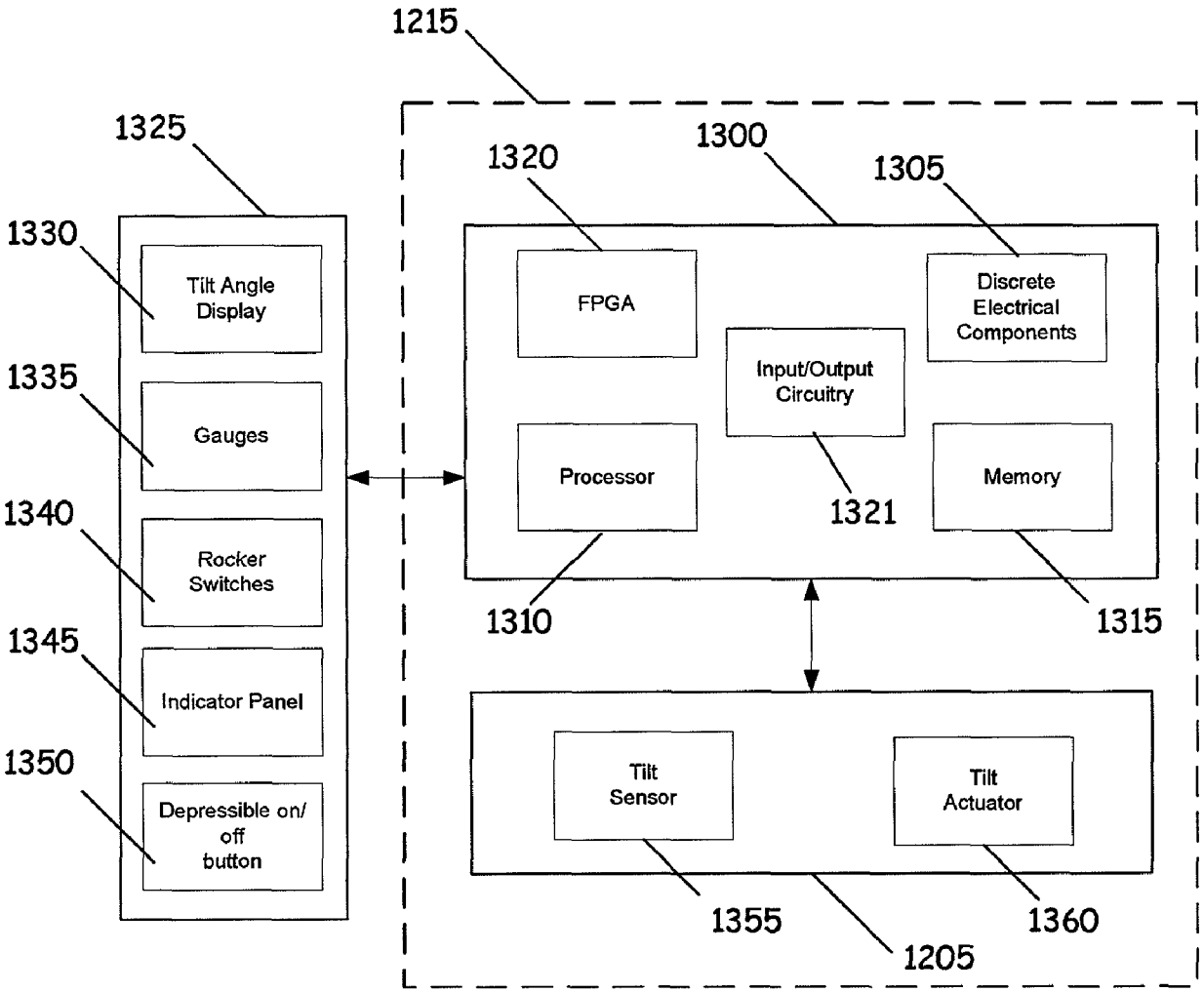
FIG. 13 in an example embodiment of a hardware component of a tilt controller.

Referring to FIG. 13, in an example embodiment the hardware component 1215 of the tilt controller 1210 includes a printed circuit board (PCB) 1300 located in an electronics housing (not shown) on the debris collection vehicle 300. Preferably, the PCB 1300 includes a plurality of discrete electrical components 1305 such as transistors, capacitors, inductors, resistors and functional integrated circuitry, a processor 1310, a memory element 1315, such as read-only memory (ROM) and/or random access memory (RAM), a field programmable logic array (FPGA) 1320, and input/output circuitry 1321.

The processor 1310 provides overall functionality by performing a variety of data processing tasks such as communication with a plurality of functional electronics on a central console 1325 and on the side broom 1205.

In general, the central console 1325 can include gauges for auxiliary engine coolant temperature, engine diagnostics such as oil pressure, charging voltage, fuel level, hour meter and engine speed. Further, the central console 1325 can include side broom specific functionality such as one or more side broom tilt angle displays 1330 which may be specified in units of degrees. In an example embodiment, one side broom tilt angle display 1330 may present a tilt angle Q of a side broom disposed on a side A of the debris collection vehicle 300, and a second side broom tilt angle display 1330 may present a tilt angle R of a side broom disposed on a side B of the debris collection vehicle 300. Additionally, the central console 1325 may include one or more gauges 1335, one or more rocker switches 1340, an indicator panel 1345, and one or more depressible on/off buttons 1350.

In the example embodiment the processor 1300 is additionally in communication with a tilt sensor 1355 and a tilt actuator 1360 disposed on the side broom 1205. The tilt sensor 1355 functions to monitor and return a side broom tilt 1230 to the processor 1300 for display on the side broom tilt angle display 1330. The tilt actuator 1360 is configured to provide side broom tilt actuation as desired by the operator via respective controls on the central console 1325. It will be appreciated that there are many different types of tilt sensor and actuator technologies commonly available. For example capacitive tilt sensors and linear electric actuators are readily commercially available.

Figure 14:
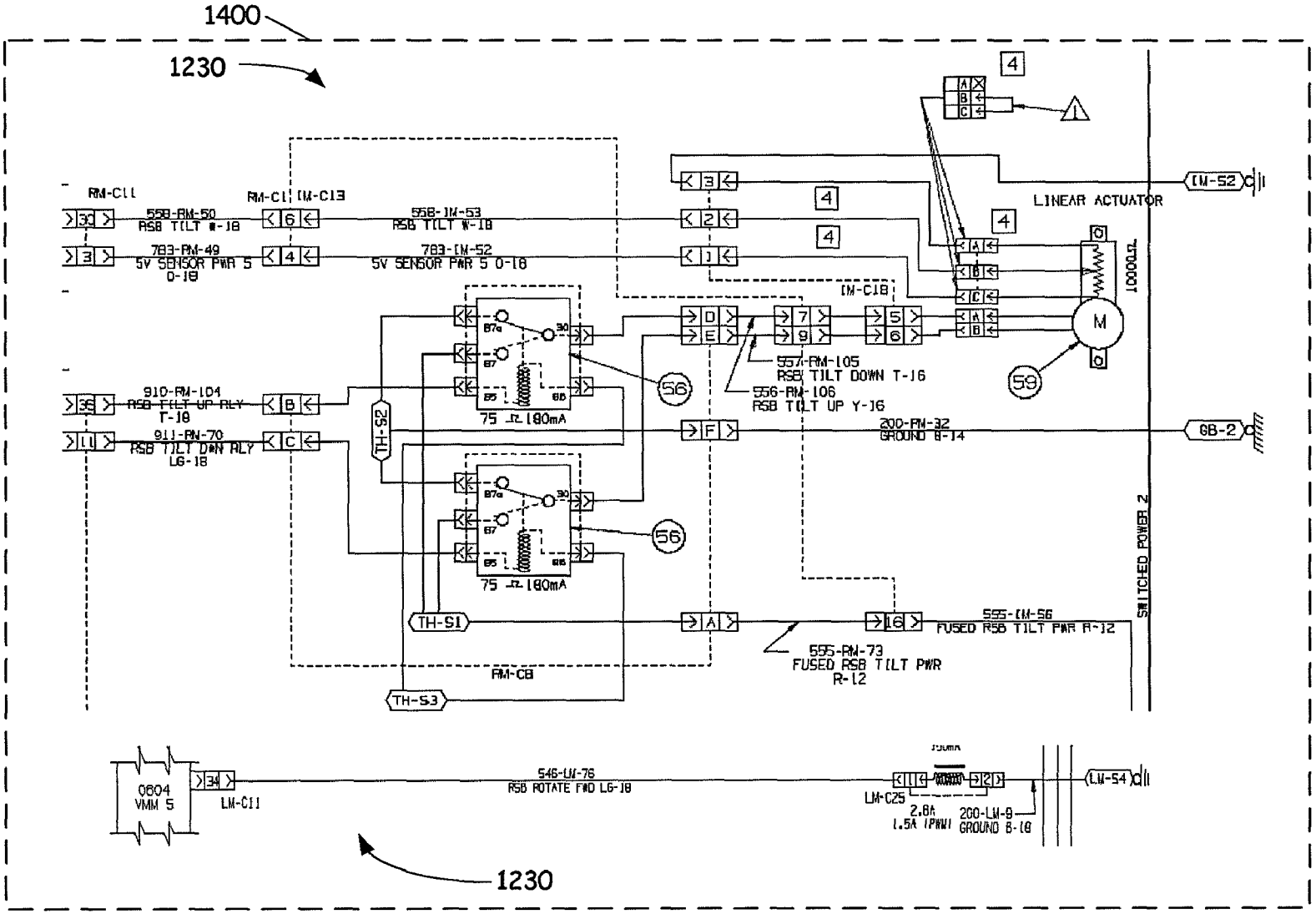
FIG. 14 is an example electrical system for the implementation of a side broom tilt, rotation, and positioning.
Figure 15:
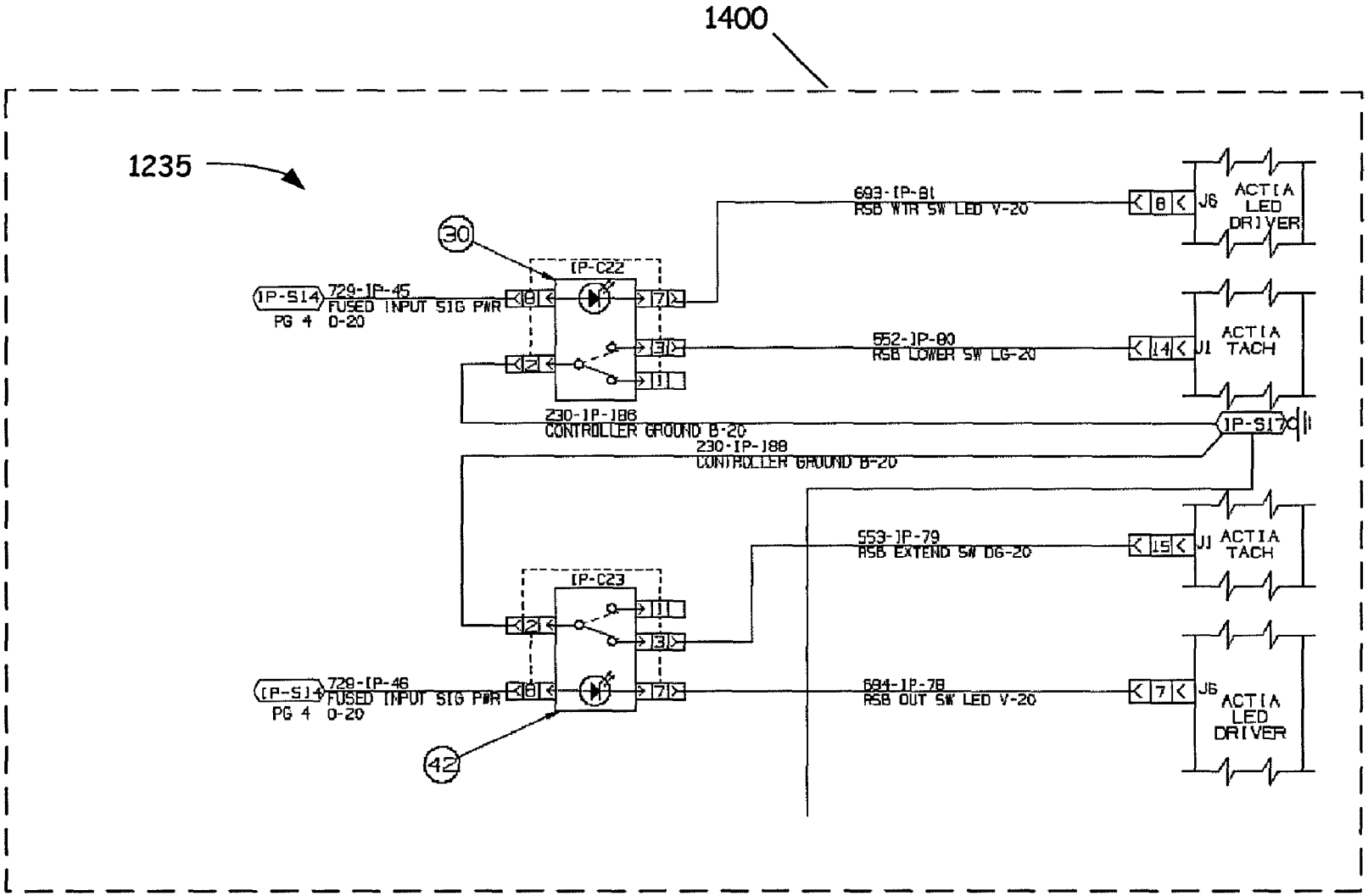
FIG. 15 is a further example electrical system for the implementation of a side broom tilt, rotation, and positioning of FIG. 14.
Figure 16:
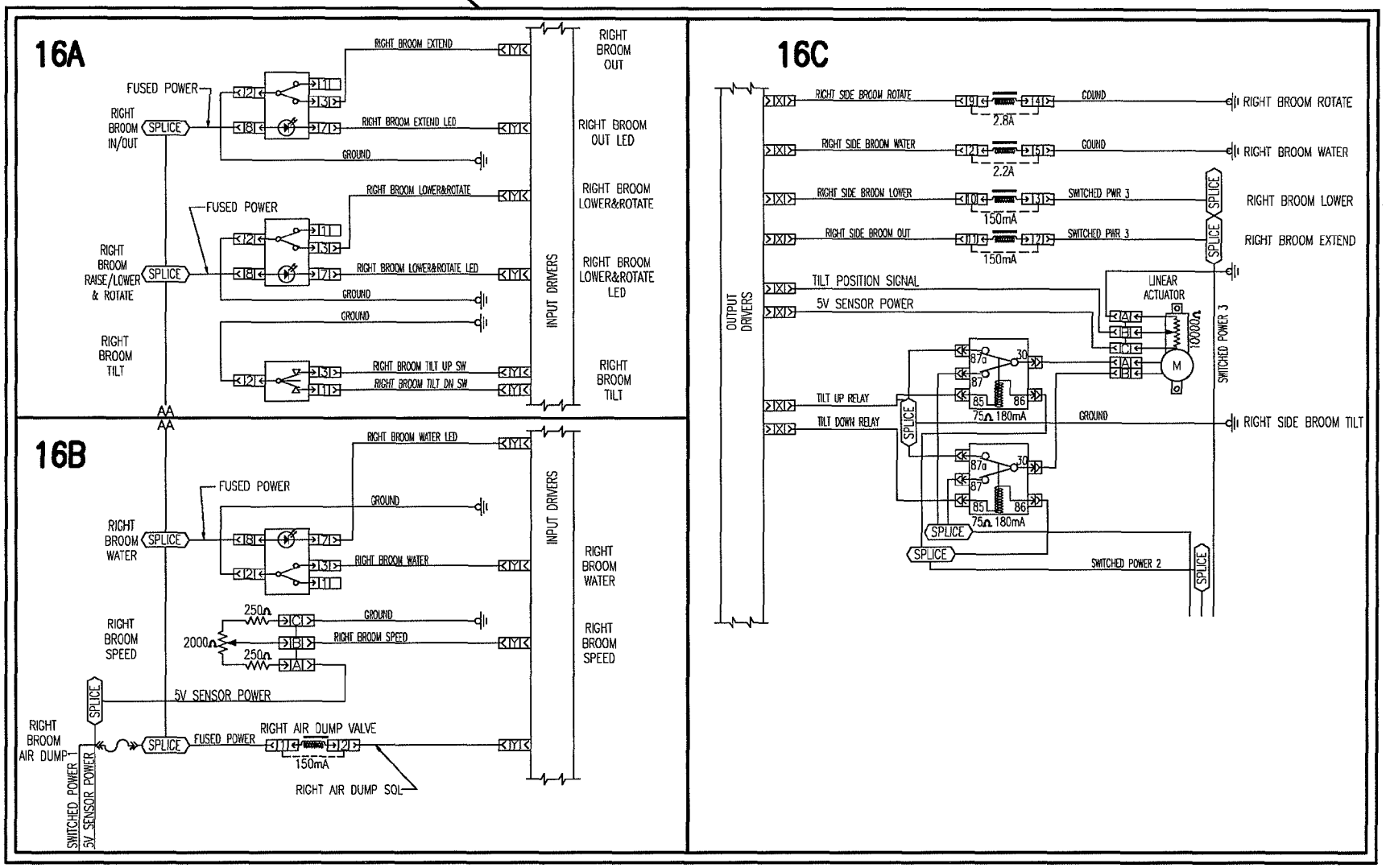
FIG. 16 is an additional further example electrical system for the implementation of a side broom tilt, rotation, and positioning of FIG. 14.
Figure 16A:
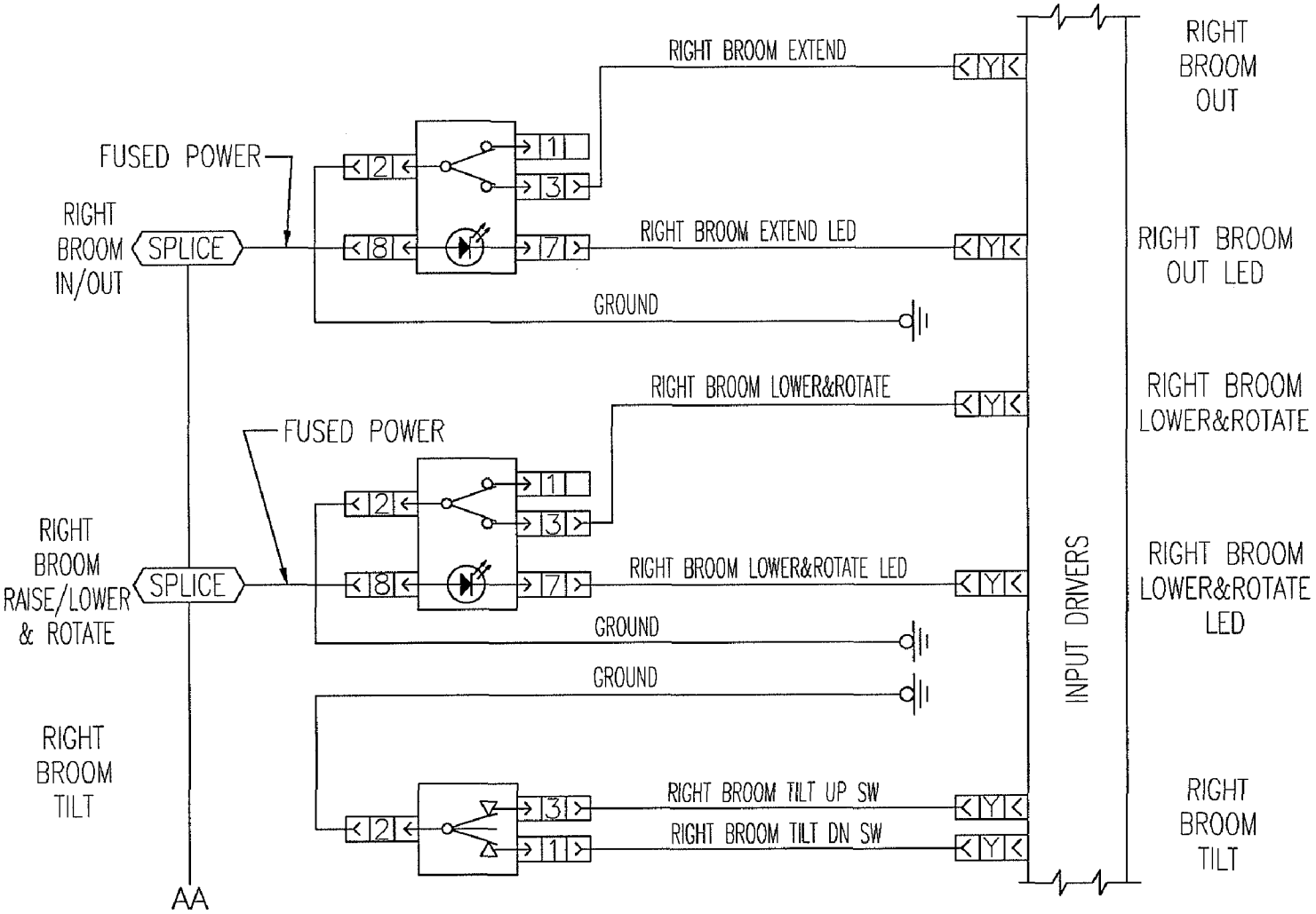
FIGS. 16A-16C show exploded views of portions of FIG. 16.
Figure 16B:
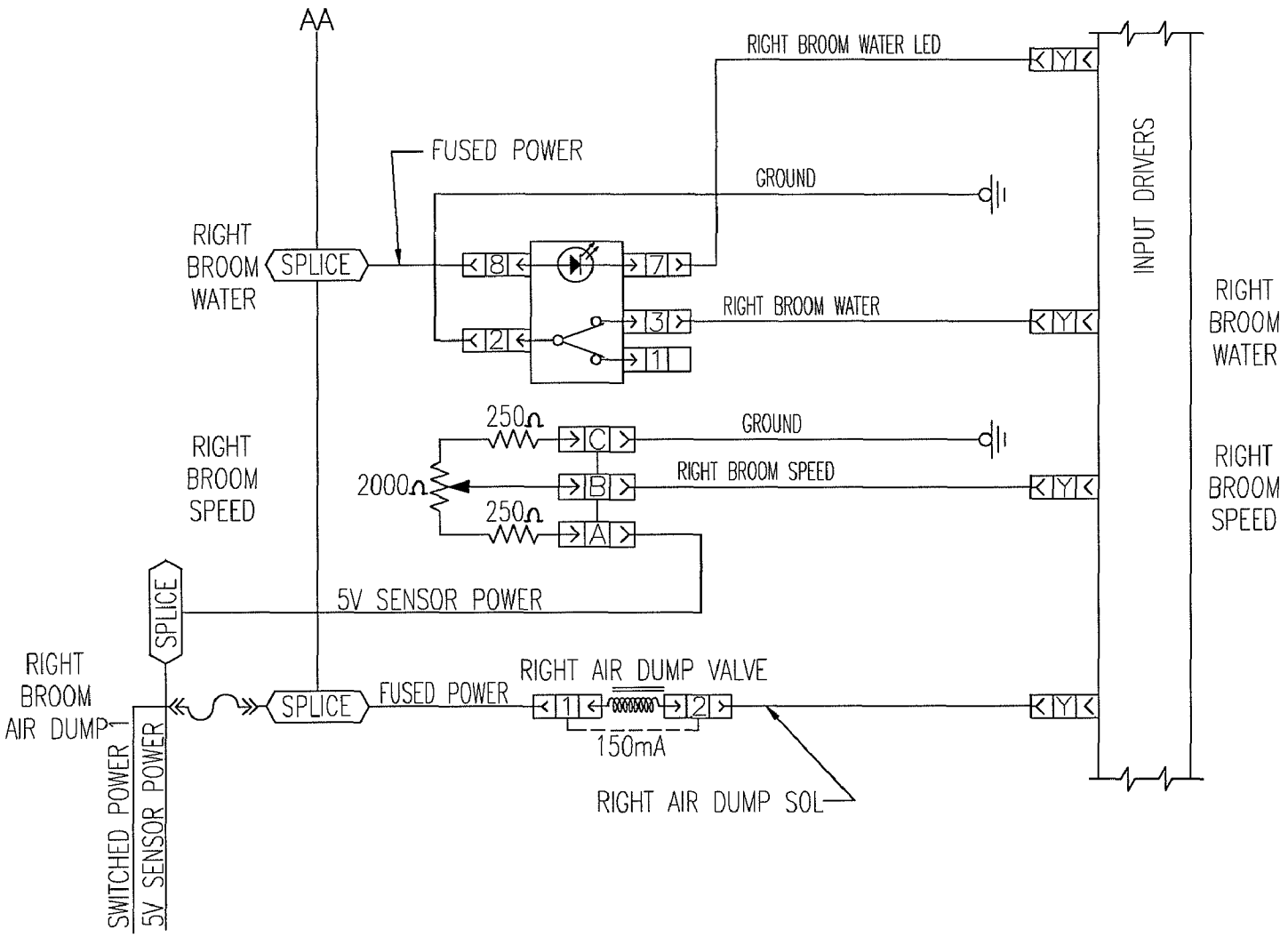
Figure 16C:
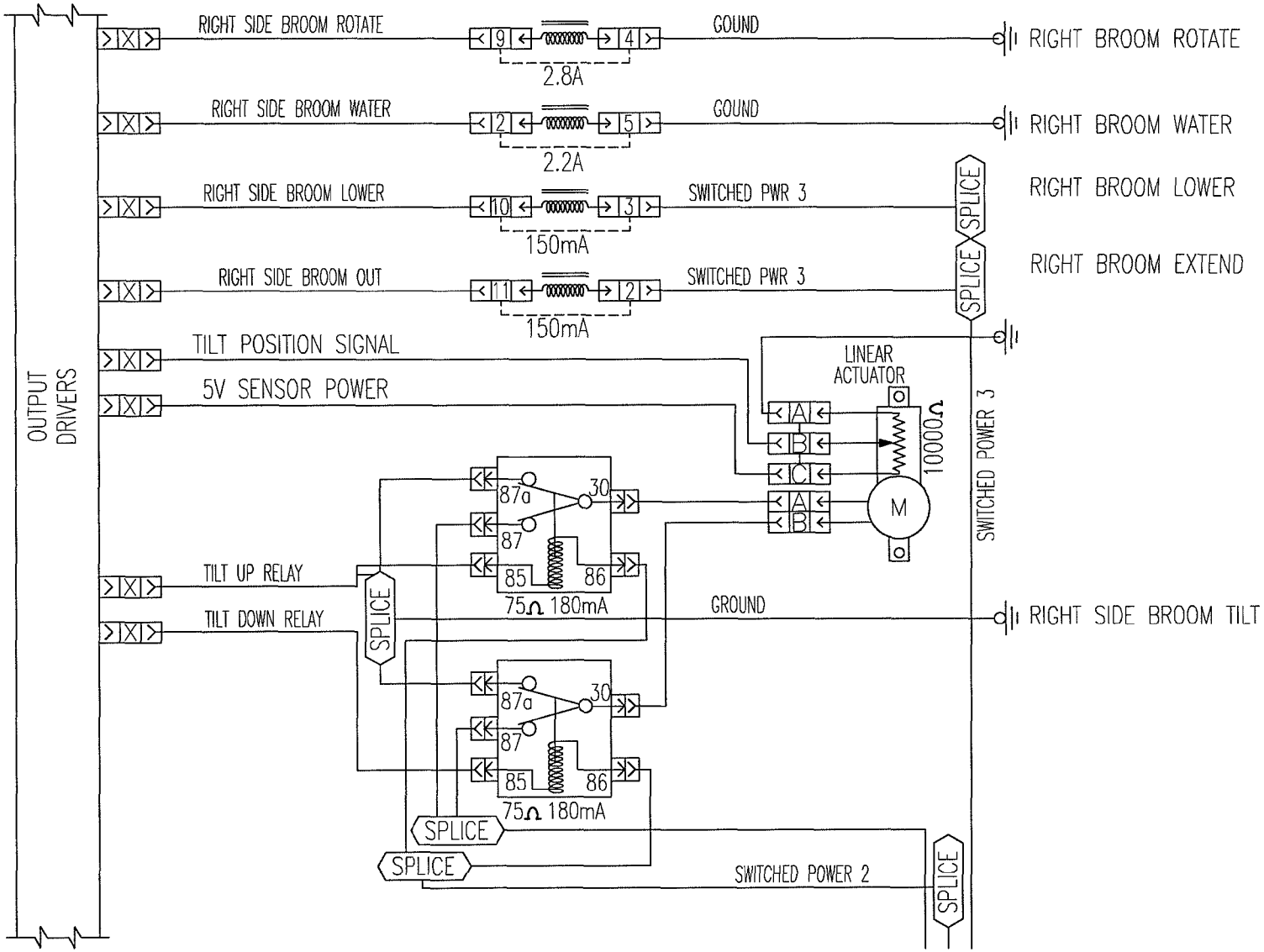

Now referring to FIGS. 14-16, an example electrical system 1400 is shown in which some aspects of the present disclosure can be implemented. More specifically, the electrical system 1400 is an electrical schematic for the implementation the side broom tilt 1230, side broom positioning 1235 and side broom rotation 1240. The example electrical system 1400 is located on the debris collection vehicle 300 and can include analog or digital circuitry or any combination thereof. Additionally, the example electrical system 1400 can include a plurality of electrical components such as resistors, capacitors switches, fuses, diodes and the like. In the example embodiment the portions of the electrical system 1400 used to implement the respective side broom manipulation features, including the memory recall module 1245, are interfaceable via the central console 1325. It will be appreciated that the electrical system 1400 is only an example implementation of aspects of the present disclosure and is not intended to be limiting.

Figure 17:
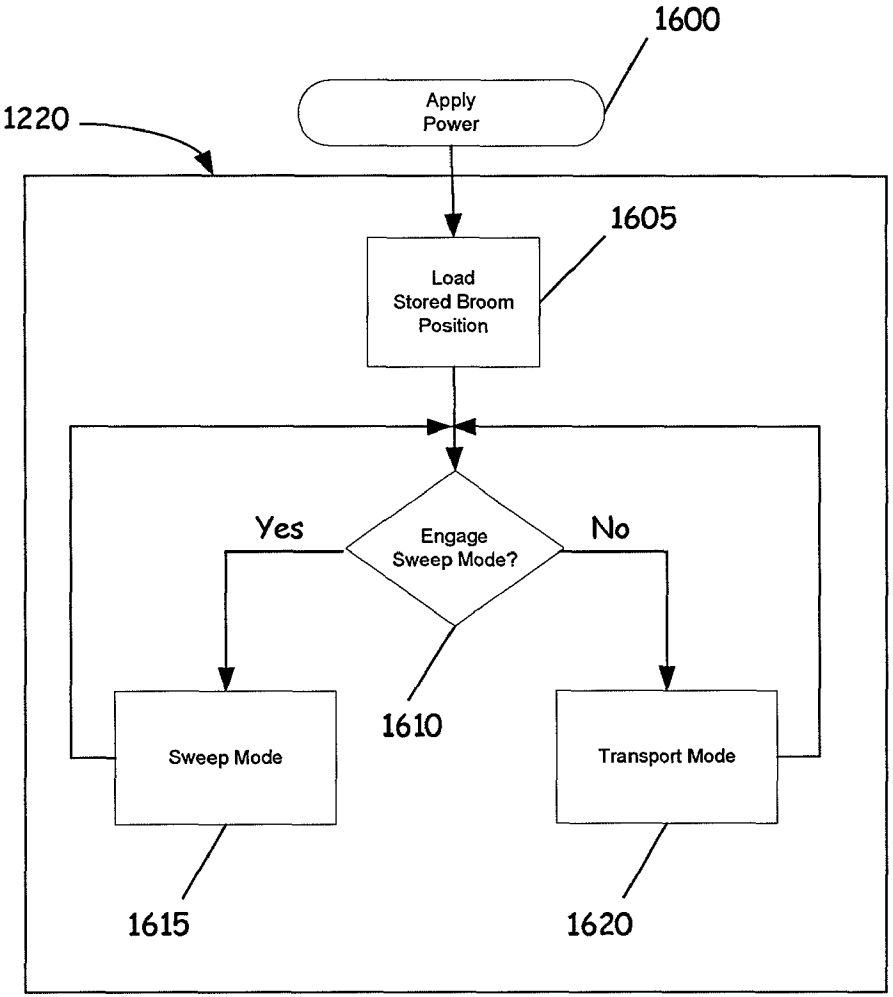
FIG. 17 is an example embodiment of a software architecture for the implementation of a tilt controller.
Figure 18:
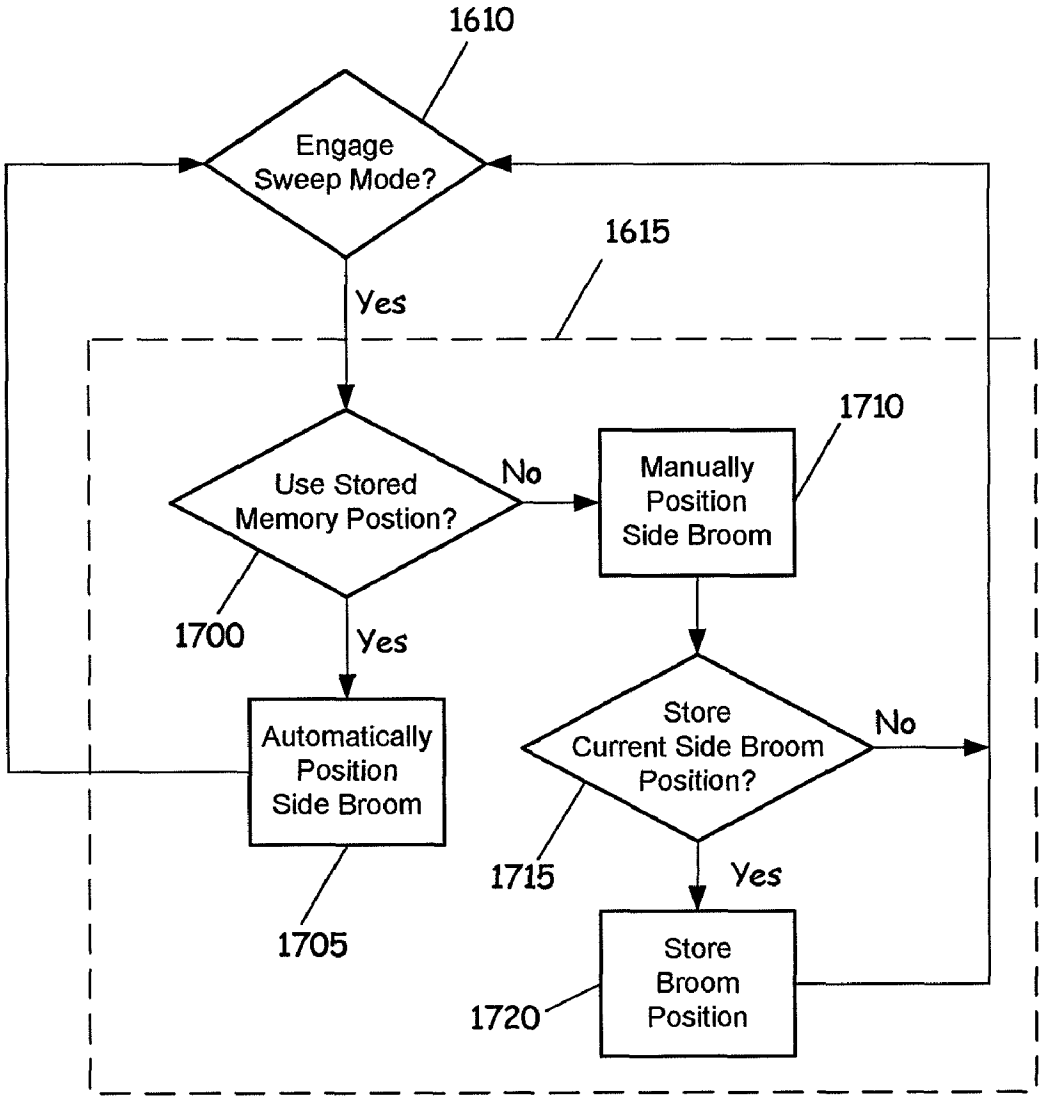
FIG. 18 is an example embodiment of a sweep mode module of the software architecture of FIG. 17.
Figure 19:
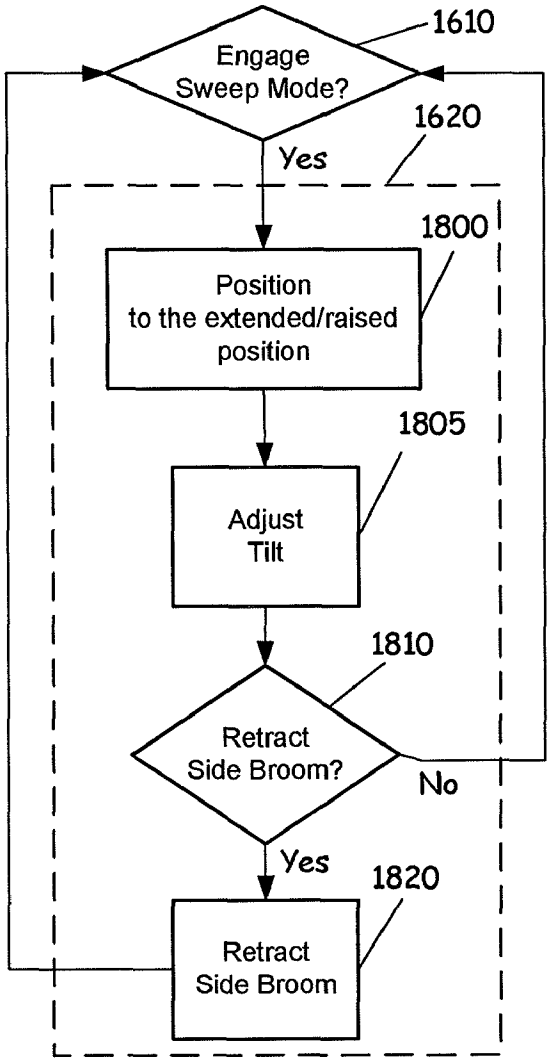
FIG. 19 is an example embodiment of a transport mode module of the software architecture of FIG. 17.

Referring now to FIGS. 17-19, the tilt controller 1210 also includes a software component 1220 used in tandem with the hardware component 1215 for the deployment and positioning of the side broom 1205. In general, the software component 1220 enables the operator 1225 to operate the side broom 1205 in two modes, namely a sweep mode and a transport mode. The sweep mode allows for the side broom tilt 1230, side broom positioning 1235 and side broom rotation 1240 (herein side broom positional variables) to be manually set by the operator 1225 via controls on the central console 1325. Further, the sweep mode allows the operator 1225 to save in a memory element the respective side broom positional variables such that an automated redeployment of the side broom 1205, as specified by the saved positional variables, can be performed. The transport mode is utilized to actuate the side broom 1205 into a position to prevent harmful contact with the street surface 135 when the debris collection vehicle 100 is in transit between cleaning sites.

In the example embodiment, the software component 1220 is instantiated at operation 1600 by application of power; the power can be applied via a depressible on/off button 1350 or a rocker switch 1340 on the central console 1325. Process flow proceeds to operation 1605 where side broom positional variables stored in a memory element, such as memory element 1315, are set to a known default values. In general, the known default values may be programmable at any time and may be stored on a non-volatile memory element such as the FPGA 1320.

Next at operation 1610, a broom mode is to be determined by the operator, the broom mode may be selected by manipulating a rocker switch 1435 on the central console 1345. As previously stated, in the example the operator 1225 is provided with a choice between a sweep mode, embodied as module 1615, and a transport mode that is represented by module 1620.

Referring now to FIG. 18, upon engagement of the sweep mode module 1615 process flow control proceeds to operation 1700 where the operator 1225 is optionally provided the opportunity to use positional variables stored in a memory element, such as memory element 1315, to position the side broom 1205. Upon an affirmative response at operation 1700 operation flow proceeds to operation 1705. At operation 1705 positional variables are recalled from a designated memory element and the tilt controller 1210 proceeds to control the mechanical positioning of the side broom 1205 to a position represented by a 3-dimensional coordinate scheme and a specified side broom tilt angle O. In the example embodiment operation 1705 is representative of the memory recall module 1605, wherein the 3-dimensional positioning of the side broom 1205 can be accomplished via the broom linkage assembly 605 and the side broom tilt angle adjustment is performed via a feedback mechanism between the tilt actuator 1360 and the tilt sensor 1355. Upon the completion of the automatic positioning accomplished at operation 1705 process flow proceeds back to operation 1610 where the operator 1225 can engage one or more cleaning functions such as the side broom rotation 1240 or engage the transport mode module 1620.

Now referring back to operation 1700, the operator 1225 is optionally provided the opportunity to manually position the side broom 1205 at operation 1710 in favor of the automatic positioning accomplished at operation 1705. More specifically, at operation 1710 respective controls on the central console are activated such that the operator 1225 can manually set the side broom tilt 1230, side broom positioning 1235, and side broom rotation 1240. Subsequently, at operation 1715 the operator may store the current side broom positional variables at operation 1720 in a respective memory element available for recall or proceed to operation 1610 where the operator 1225 can engage one or more cleaning functions such as the side broom rotation 1240 or engage the transport mode module 1620.

Referring to FIG. 19, when the debris collection vehicle 300 is in transit between cleaning sites the side broom 1205 is preferably in either the stowed position 500 or in a raised/extended position 600 so as to prevent harmful contact with the street surface 335. To achieve this the operator 1225 can set the side broom 1205 into a position appropriate for traveling by engaging the transport mode module 1620. In the example embodiment the transport mode module 1620 is representative of the memory recall module 1605, wherein the 3-dimensional positioning of the side broom 1205 can be accomplished via the broom linkage assembly 605 and the side broom tilt angle adjustment is performed via a feedback mechanism between the tilt actuator 1360 and the tilt sensor 1355.

Initially upon selection of transport mode module 1620 process flow proceeds to operation 1800 wherein the side broom 1205 is automatically moved into the raised/extended position 600. In the example embodiment the position of the broom linkage assembly 605 corresponding to the raised/extended position 600 being recalled from memory element 1315 or FPGA 1320. Process flow then proceeds to operation 1805 which iterates the side broom tilt 1230 into a programmable position. In certain embodiments operation 1805 can actuate the side broom tilt angle O to a value consistent with an angle necessary for the placement of the side broom 1205 in a stowed position 500. It will be appreciated that the side broom tilt angle O actuated at operation 1805 is arbitrary. Next, at operation 1810 the operator 1225 is optionally provided the opportunity to retract the side broom 1205 into the stowed position 500. Upon an affirmative decision at operation 1810 the side broom 1205 is retracted at operation 1820 and then operation flow proceeds to 1610 where the operator 1225 can engage one or more cleaning functions such as the side broom rotation 1205 or engage the transport mode module 1620. Alternatively, the operator may 1225 chose to not retract the side broom at operation 1810 and simply proceed to operation 1610.

The preceding embodiments are intended to illustrate without limitation the utility and scope of the present disclosure. Those skilled in the art will readily recognize various modifications and changes that may be made to the embodiments described above without departing from the true spirit and scope of the disclosure.

The invention claimed is:

1. A debris collection vehicle having a chassis and a cab comprising:

a broom linkage assembly connected to the chassis, the broom linkage assembly enabling a broom tilt, position, and rotation;

a broom connected to the broom linkage assembly for cleaning a cleaning surface; and a broom controller configured to control the broom linkage, the broom controller including a memory for storing a set of current broom tilt angle, position, and rotation, the set of current broom tilt angle, position and rotation being one of a plurality of sets of broom tilt angle, position and rotation stored in the memory;

whereby the broom controller can recall any of the plurality of sets of broom tilt angle, position, and rotation and control the broom linkage based on the recalled broom tilt angle, position and rotation to redeploy the broom to the recalled broom tilt angle, position and rotation, whereby each time any one set of the plurality of sets of broom tilt angle, position, and rotation is recalled, the broom controller redeploys the broom to a same set of broom tilt angle, position and rotation as for a previous recall of the one set of broom tilt angle, position and rotation.

2. The debris collection vehicle of claim 1, wherein the broom controller includes a tilt sensor and a tilt actuator to determine a tilt of the broom.

3. The debris collection vehicle of claim 1, further comprising a tilt actuator positioned on the broom being configured to actuate the broom between a tilted position and a non-tilted position.

4. The debris collection vehicle of claim 3, wherein the tilt actuator can actuate a broom tilt in any orientation with respect to a stationary axis.

5. The debris collection vehicle of claim 3, wherein the broom tilt is measured by a broom tilt angle, the broom tilt angle measured with respect to a set of orthonormal axis.

6. The debris collection vehicle of claim 5, wherein the broom tilt has a full range of motion ranging from zero degrees to twenty degrees.

7. A tilt controller positioned on a debris collection device, the tilt controller having a hardware and a software component configured to control a side broom tilt, a side broom positioning, and a side broom rotation, wherein the tilt controller can recall the side broom positioning and the side broom tilt for automatic displacement of the side broom, the tilt controller comprising:

a memory element to store a set of a side broom tilt angle and a side broom positioning; and a memory recall module to automatically position to the set of the side broom tilt and side broom positioning, the memory recall module obtaining the set of the side broom tilt angle and the side broom positioning from the memory element, whereby each time the memory recall module obtains the set of side broom tilt angle and side broom positioning from the memory element, the memory recall module automatically positions to a same set of side broom tilt and side broom positioning as for a previous recall of the set of side broom tilt angle and side broom positioning.

8. The tilt controller of claim 7, wherein the tilt controller updates an operator display to display the side broom tilt angle.

9. The tilt controller of claim 7, wherein the tilt controller receives an operator input via a central console to manually control the side broom tilt angle.

10. The tilt controller of claim 7, wherein the tilt controller receives an operator input via a central console to manually control the side broom positioning.

11. A method of automatically deploying a side broom positioned on a debris collection vehicle having a chassis and a cab, wherein a tilt controller is configured to actuate the side broom to a known side broom positioning and a known side broom tilt, the method comprising:

recalling one of a plurality of sets of previously stored side broom tilt angle, position, rotation and a side broom 3-dimensional coordinate from an electronic memory element;

deploying the side broom to the 3-dimensional coordinate via a broom linkage connected to the chassis; and actuating the side broom to the side broom tilt angle via a tilt actuator positioned on the side broom.

12. The method of claim 11, wherein a central console is located within the cab for operating the tilt controller.

13. The method of claim 11, wherein the side broom tilt has a full range of motion ranging from zero degrees to twenty degrees.

14. The method of claim 11, wherein the tilt controller updates an operator display to display the side broom tilt angle.

* * * * *